US005890265A

United States Patent [19]

Christian et al.

[11] Patent Number: 5,890,265

[45] Date of Patent: Apr. 6, 1999

[54] PARALLEL ENTRY TIE

[75] Inventors: Kenneth A. Christian, Milwaukee; Mark E. Federspiel, West Bend, both of Wis.

[73] Assignee: Tyton Hellermann Corporation, Milwaukee, Wis.

[21] Appl. No.: 833,640

[22] Filed: Apr. 8, 1997

Related U.S. Application Data

[63] Continuation of Ser. No. 571,396, Dec. 13, 1995, abandoned.

[51] Int. Cl.[6] ..... B65D 63/00

[52] U.S. Cl. ..... 24/16 PB; 24/30.5 P

[58] Field of Search ..... 24/16 PB, 16 R, 24/17 AP, 30.5 R, 30.5 P; 248/74.3

[56] References Cited

U.S. PATENT DOCUMENTS

| | | | |
|---|---|---|---|
| Re. 31,689 | 10/1984 | Bulanda et al. | 24/16 PB |
| 3,660,869 | 5/1972 | Caveney et al. | 24/16 PB |
| 3,731,347 | 5/1973 | Caveney et al. | 24/16 PB |
| 3,816,878 | 6/1974 | Fulton et al. | 24/16 PB |
| 3,872,547 | 3/1975 | Caveney et al. | 24/16 PB |
| 3,906,593 | 9/1975 | Caveney et al. | 24/16 PB |
| 3,908,233 | 9/1975 | Caveney et al. | 24/16 PB |
| 3,949,449 | 4/1976 | Caveney et al. | 24/16 PB |
| 3,965,538 | 6/1976 | Caveney et al. | 24/16 PB |
| 3,991,444 | 11/1976 | Bailey | 24/16 PB |
| 3,996,646 | 12/1976 | Caveney | 24/16 PB |
| 4,001,898 | 1/1977 | Caveney | 24/16 PB |
| 4,003,106 | 1/1977 | Schumacher et al. | 24/16 PB |
| 4,135,749 | 1/1979 | Caveney et al. | 292/317 |
| 4,188,004 | 2/1980 | Fulton et al. . | |
| 4,191,334 | 3/1980 | Bulanda et al. | 24/16 PB |
| 4,499,680 | 2/1985 | Coburn | 24/16 PB X |
| 4,688,302 | 8/1987 | Caveney et al. | 24/16 PB |
| 4,866,816 | 9/1989 | Caveney | 24/16 PB |
| 4,882,813 | 11/1989 | Nakamura | 24/16 PB |
| 4,951,362 | 8/1990 | Denemark et al. | 24/16 PB |
| 5,103,534 | 4/1992 | Caveney | 24/16 PB |
| 5,121,524 | 6/1992 | Mortensen | 24/16 PB |
| 5,146,654 | 9/1992 | Caveney et al. | 24/16 PB |
| 5,193,250 | 3/1993 | Caveney | 24/16 PB |
| 5,267,373 | 12/1993 | Chisek | 24/16 PB |
| 5,745,957 | 5/1998 | Khokhar et al. | 24/16 PB |

FOREIGN PATENT DOCUMENTS

| | | | |
|---|---|---|---|
| 90726 | 10/1983 | European Pat. Off. | 24/16 PB |
| 2462600 | 3/1981 | France | 24/16 PB |
| 2097053 | 10/1982 | United Kingdom | 24/16 PB |

*Primary Examiner*—James R. Brittain
*Attorney, Agent, or Firm*—Ryan Kromholz & Manion

[57] ABSTRACT

A flexible strap has a locking head and a free end. The strap is received in a passage in the locking head where it is engaged by a locking tab which is biased toward engagement with the strap as it passes into and through the passage. The locking tab prevents withdrawal of the tie from the locking head. The strap can be released for withdrawal from the locking head by moving the tab against the bias. An opening is provided in the locking head generally opposite to the location of the locking tab. The strap, throughout the major portion of its extension, has a width which is less than the width of the opening. The opening in the locking head is preferably provided with spaced shoulders in the area of the engagement between the locking tab and the straps serrations. An inclined lip is provided in the area through which the strap exits the locking head. The lip is angled such as to displace the strap from the normal exterior of the strap.

10 Claims, 2 Drawing Sheets

PARALLEL ENTRY TIE

This is a continuation of application(s) Ser. No. 08/571, 396 filed on Dec. 13. 1995, abandoned.

BACKGROUND OF THE INVENTION

This is invention relates to flexible ties and, more particularly, ties of the parallel entry type.

Flexible ties for use in bundling elongated members such as wires, cables, etc. are well known. Typically, such ties include an elongated flexible strap made of suitable plastic material. The tie usually has a free end and a locking mechanism at the opposite end. The strap is capable of being turned on itself 360° for insertion into the locking head after which the diameter of the loop thus formed can be adjusted to snugly fit over the intended bundle.

A parallel entry tie is one wherein the insertion of the strap into the locking head and then its extension into and through the locking head is generally in alignment with the loop which is formed, as opposed to being at a lateral angle to the loop.

Various constructions of parallel entry ties have been proposed. The desirable characteristic in any tie, and particularly so in a parallel entry tie, is a low insertion force while obtaining a positive and reliable connection of the strap in the locking head to maintain the adjusted loop diameter. For the most part, prior ties of this type have been lacking in either one or both of those characteristics.

SUMMARY OF THE INVENTION

It is, therefore, an object of this invention to provide a new and improved tie, particularly a parallel entry tie, which demonstrates desirable holding characteristics as well as a low insertion force.

For the achievement of those and other objects, this invention proposes a flexible tie construction including a strap and a locking head which receives the free end of the strap when the strap is looped. The strap is received in a passage in the locking head for selective engagement by a locking tab supported on the locking head, the locking tab having a bias toward and into the passage. The locking tab then engages the strap as the strap passes into and through the passage and selectively engages serrations on the strap to prevent withdrawal of the tie from the locking head. The strap can be released for withdrawal from the locking head by moving the locking tab against the bias. The locking tab is attached to a first rib by a hinge section that biases the locking tab in a first position and the locking tab abuts the first rib when a load being applied to the said strap.

An opening is provided in the locking head generally opposite to the location of the locking tab. The strap, throughout the major portion of its extension, has a width which is preferably no greater, or less, than the width of the opening. The opening in the locking head is preferably provided with spaced shoulders in the area of the engagement between the locking tab and the straps serrations.

Also in the preferred embodiment, an inclined lip is provided in the area through which the strap exits the locking head. The lip is angled such as to displace the strap from the normal extension of the passage and the strap adjacent the locking head.

DETAILED DESCRIPTION OF THE PREFERRED EMBODIMENT

Figure 1:
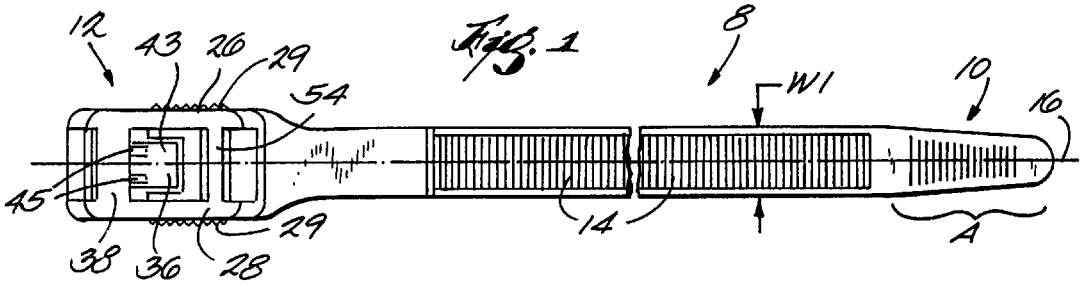
FIG. 1 is a plan view of a flexible tie of the present invention.
Figure 2:
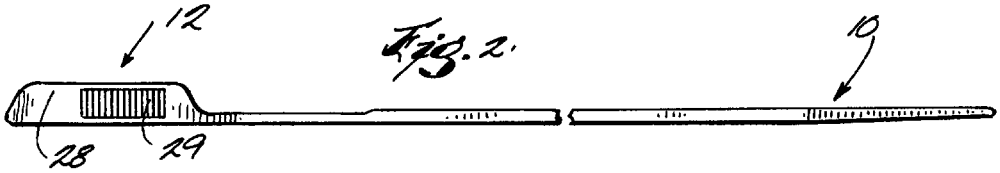
FIG. 2 is a side view of the flexible tie of FIG. 1.

Referring to FIGS. 1 and 2, the invention includes a strap 8 including a free end 10 and a locking head 12 disposed at the opposite end. A series of serrations 14 are provided along a length of the strap 8.

As can be seen in FIG. 1, in its normal or first state, the strap 8 has a general extension along a longitudinal axis 16. In a conventional manner and therefore not shown, the strap 8 can be looped on itself to position the free end 10 at the locking head 12. This is partially illustrated in FIGS. 3, 4 and 5 that is, the free end 10 is shown as being at and then ultimately in and through the locking head 12 but the remaining looped portion of the strap 8 has not been illustrated.

Figure 3:
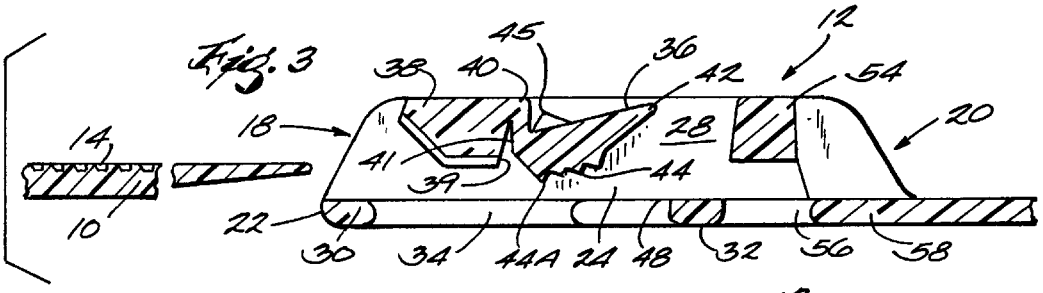
FIG. 3 is a section view through the free end of the flexible tie and the locking head after the strap has been looped on itself and just prior to entry of the strap into the locking head.

Referring to FIG. 3, the locking head 12 includes an entrance end 18, an exit end 20 and a lower side 22. The lower side 22 of the locking head 12 is generally in alignment with the normal extension of the strap 8. A passage 24 is defined in the locking head 12 to receive the free end 10. This will be discussed more completely hereinafter. The passage 24 is formed in part by lower side 22 and side walls 26 and 28 (FIG. 1). Side walls 26 and 28 have thereon ribs 29 which act as finger grips to enable the locking head 12 to be more securely held by the user (FIG. 2).

The lower side 22 of the locking head 12 is formed by a pair of ribs 30 and 32 which are spaced apart to define an opening 34 therebetween.

A rib 54 is provided between side walls 26 and 28 at the exit end 20 of the locking head 12. Rib 54, in cooperation with rib 32, insures effective movement of the free end 10 of the strap 8 through passage 24 and out of exit end 20. An opening 56 is provided in the lower portion 22 between rib 32 and another rib like portion 58, with that opening being generally opposite to rib 54. This arrangement again enhances the reduction in the insertion force required to move the free end 10 of the strap 8 through the locking head 12.

A locking tab 36 is positioned opposite to opening 34 and is connected to a rib 38 which extends between the side walls 26 and 28. The locking tab 36 has thereon a plurality of teeth 44. The connection between locking head 36 and rib 38 is through a hinge section 40. The hinge section 40 produces a natural bias on the locking tab 36 in a clockwise direction as viewed in FIGS. 3, 4 and 6. When the free end 10 of the strap 8 is not in passage 24, the locking tab 36 assumes the normal or first position as viewed in FIG. 3.

Figure 4:
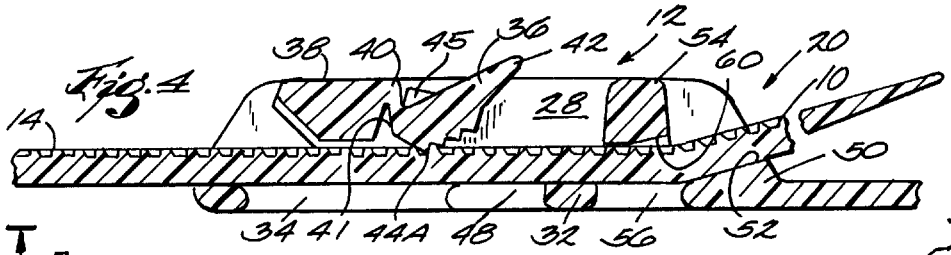
FIG. 4 is a section view similar to FIG. 3 but with the strap inserted into and partially through the locking head.

As the free end 10 of the strap 8 is inserted into the passage 24 as shown in FIG. 4, the locking tab 36 moves from its first position to a second position in which the hinge section 40 provides that only one tooth 44A of the locking tab 36 engages the serrations 14 and the locking tab 36 is moved in a counterclockwise direction, against the bias to enable the tooth 44A to sequentially engage the serrations 14. With only one tooth 44A engaging the serrations 14, this minimizes the insertion force of the free end 10 of the strap 8 into the passage 24.

Figure 6:
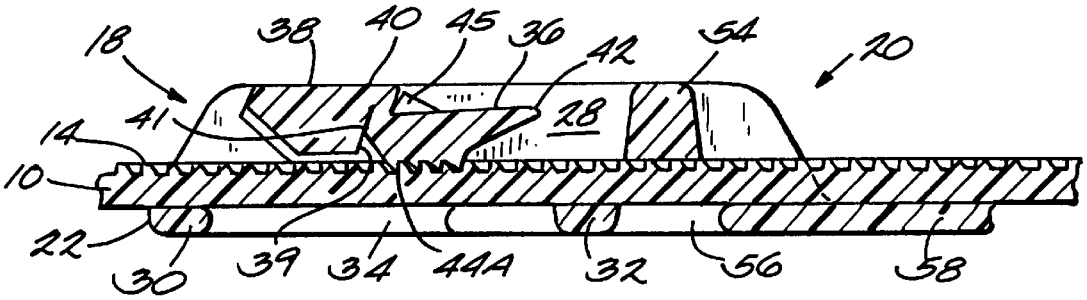
FIG. 6 is a section view similar to FIG. 3 showing the flexible tie in its loaded or locked position.

When the free end 10 of the strap 8 comes to rest in any position in the passage 24 and the free end 10 is loaded, i.e., in its selected operational diameter, there will be a force on the strap 8 attempting to pull the free end 10 toward the entrance end 18. The force will move the locking tab 36 in a clockwise direction thus engaging all of the teeth 44 with the serrations 14. In this loaded or locked position as shown in FIG. 6, the surface 39 of rib 38 abuts or is in engagement with the opposed surface 41 of the locking tab 36 so that the tension forces applied on the strap 8 are absorbed by surfaces 39 and 41. In the locked position, withdrawal of the free end 10 from the passage 24 is prevented.

As shown in FIG. 6, tip portion 42 at the end of the locking tab 36 allows for ready release of the free end 10 of the strap 8 from the passage 24. To release the free end 10, the tip portion 42 is lifted upwardly to disengage the teeth 44 from the serrations 14 and allow the free end 10 to be removed from passage 24. This release feature is important in instances where strap 8 is reusable or is used in an application where cutting the free end 10 may expose the surrounding material to damage. In an alternative embodiment not shown, if the strap 8 does not need to be releasable, tip portion 42 can be omitted from locking tab 36.

Referring to FIG. 1, the locking tab 36 has on its top surface 43 two stops 45. The stops 45 limit the upward and counterclockwise movement of the locking tab 36 so that when the free end 10 is being released from the passage 24, the locking tab 36 is not overextended or damaged.

Figure 5:
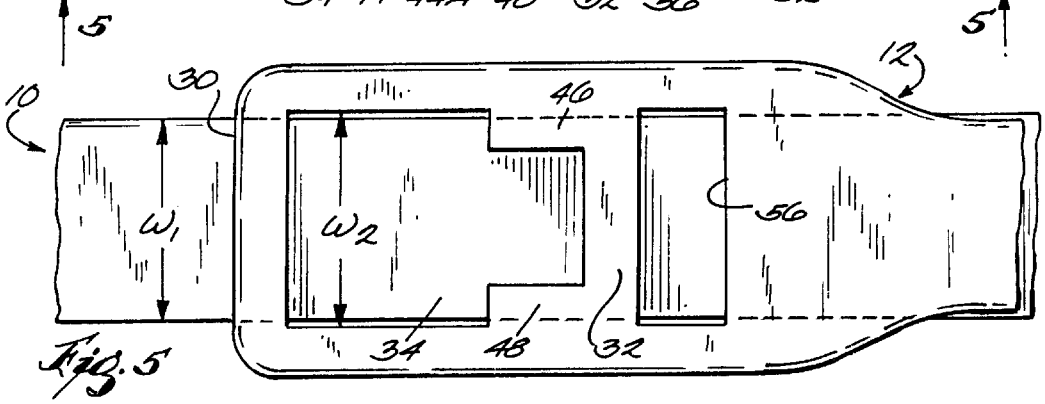
FIG. 5 is a bottom view of FIG. 4 generally along the lines 5—5 in FIG. 4.

With reference to FIGS. 1 and 5, the free end 10 of strap 8 has a width W1 which is generally uniform along the major extension of the free end 10 but tapers down to a lesser width in an area A adjacent the free end 10. Opening 34 has a width W2 which, in the preferred embodiment, is selected to be greater than the width W1.

The provision of the opening 34 in the locking head 12 and particularly in the area of the locking tab 36, reduces the force required to insert the free end 10 into and then through the passage 24. By providing opening 34 with a width W2 which is greater than the width W1 of the free end 10, the lowering of the insertion force is further enhanced.

Referring again to FIG. 5, a pair of spaced shoulders 46 and 48 are provided in opening 34 and in the area of the locking tab 36. The shoulders 46 and 48 overlap part of the locking tab 36 and terminate adjacent to the teeth 44 engaging the serrations 14. With this arrangement, the shoulders 46 and 48 cooperate in insuring a firm engagement between the teeth 44 on the locking tab 36 and the serrations 14 on the free end 10 without materially increasing the insertion force.

With reference to FIG. 4 and exit end 20 of the locking head 12, it will be noted that an alternate embodiment of strap 8 includes an inclined lip 50. The surface 52 of the lip 50 is inclined away from the lower portion 22 and projects into the extension of passage 24. Therefore, as the free end 10 of the strap 8 exits the locking head 12, the free end 10 is displaced from the normal extension of the passage 24. This makes the free end 10 readily accessible after the bundle diameter has been selected in the event it is desirable to sever the free end 10. Rib 54 is provided with an inclined surface 60 to better accommodate the movement of the free end 10 as it engages surface 52 and is displaced upwardly from the normal direction of passage 24.

The combination of ribs 30, 32, 38, 54, and 58, together with side walls 26 and 28 form the passage 24.

While only the preferred embodiment of the invention has been illustrated and described, it is not intended to be limited thereby, but only by the scope of the appended claims.

We claim:

1. A flexible tie comprising:

an elongate flexible strap having a head end, a tail end and a plurality of spaced serrations between the head end and the tail end;

a pair of spaced sidewalls extending forwardly from the head end defining a passageway therebetween;

a first rib extending transversely between the sidewalls substantially in the plane of the strap;

a second rib extending transversely between the sidewalls substantially in the plane of the strap, the second rib being spaced from the first rib in the direction toward the tail end of the strap so as to define a first opening between the first and second ribs;

a third rib extending transversely between the sidewalls above the plane of the strap and defining a first abutting surface oriented substantially obliquely to the plane of the strap;

a fourth rib extending transversely between the sidewalls above the plane of the strap, the fourth rib being spaced from the third rib in the direction toward the tail end of the strap so as to define a second opening between the third and fourth ribs;

the sidewalls and the first, second, third and fourth ribs being dimensioned and spaced so that the tail end of the strap can be inserted through the passageway over the first and second ribs and under the third and fourth ribs while maintaining the tail end of the strap substantially parallel to the head end of the strap;

a locking tab disposed between the third and fourth ribs and having a plurality of teeth shaped and dimensioned to engage the serrations on the strap when the strap is inserted through the passageway; and a flexible hinge extending between the third rib and the locking tab and supporting the locking tab for pivoting movement in an arc from a first position wherein only a portion of the locking tab is adjacent the plane of the strap and less than all of the teeth engage the serrations on the strap to a second position wherein substantially more of the locking tab is adjacent the plane of the strap and substantially all of the teeth engage the serrations on the strap, the locking tab including a second abutting surface oriented opposite the first abutting surface and forming an acute angle relative to the first abutting surface so as to engage the first abutting surface when the locking tab is pivotally displaced to the second position to thereby oppose further pivoting movement of the locking tab when the locking tab is substantially in the second position and substantially all of the teeth engage the serrations on the strap.

2. A flexible tie as defined in claim 1 wherein the third rib includes an angled leading edge that facilitates insertion of the tail end of the strap under the third and fourth ribs and over the first and second ribs.

3. A flexible tie as defined in claim 1 wherein the locking tab extends rearwardly from the third rib toward the fourth rib and is disposed substantially in the second opening.

4. A flexible tie as defined in claim 3 wherein the hinge comprises an elongate flexible strap extending between the third rib and the locking tab.

5. A flexible tie as defined in claim 4 wherein the locking tab includes an angled edge adjacent the third rib that deflects the locking tab toward the first position as the tail end of the strap is introduced between the sidewalls and under the third rib.

6. A flexible tie as defined in claim 5 wherein the locking tab includes structure for limiting movement of the locking tab in a direction away from the plane of the strap.

7. A flexible tie as defined in claim 6 wherein the structure comprises a stop formed on the locking tab that engages the third rib when the locking tab is fully in the first position.

8. A flexible tie as defined in claim 5 wherein the locking tab includes structure for manually deflecting the locking tab from the second position to the first position.

9. A flexible tie as defined in claim 8 wherein the structure comprises a tip portion opposite the third rib and accessible through the second opening.

10. A flexible tie comprising:

an elongate flexible strap having a head end, a tail end and a plurality of spaced serrations between the head end and the tail end;

a pair of spaced sidewalls extending forwardly from the head end defining a passageway therebetween;

a first rib extending transversely between the sidewalls substantially in the plane of the strap;

a second rib extending transversely between the sidewalls substantially in the plane of the strap, the second rib being spaced from the first rib in the direction toward the tail end of the strap so as to define a first opening between the first and second ribs;

a third rib extending transversely between the sidewalls above the plane of the strap and defining a first abutting surface;

a fourth rib extending transversely between the sidewalls above the plane of the strap, the fourth rib being spaced from the third rib in the direction toward the tail end of the strap so as to define a second opening between the third and fourth ribs;

the sidewalls and the first, second, third and fourth ribs being dimensioned and spaced so that the tail end of the strap can be inserted between the sidewalls, over the first and second ribs, and under the third and fourth ribs while maintaining the tail end of the strap substantially parallel to the head end of the strap; and a locking tab extending rearwardly from the third rib toward the fourth rib and disposed substantially in the second opening;

the locking tab being supported by means of a hinge coupled to the third rib for pivoting movement upwardly from, and downwardly toward, the plane of the strap, the locking tab thereby being movable from a first position wherein only a portion of the locking tab is adjacent the plane of the strap to a second position wherein substantially more of the locking tab is adjacent the plane of the strap, the locking tab including a second abutting surface oriented opposite the first abutting surface and positioned so as to engage the first abutting surface when the locking tab is displaced toward the third rib to thereby oppose further movement of the locking tab toward the third rib;

the locking head further including an angled edge adjacent the third rib that deflects the locking tab toward the first position as the tail end of the strap is introduced between the sidewalls and under the third rib, the locking tab further including a plurality of teeth shaped and dimensioned to engage the serrations on the strap when the strap is inserted between the sidewalls wherein a fewer number of the teeth engage the serrations when the locking tab is displaced away from the plane of the strap than when the locking tab is displaced toward the plane of the strap; and the locking tab further including a pair of stops that engage the third rib when the locking tab is fully in the first position to limit movement of the locking tab in a direction away from the plane of the strap.

* * * * *